United States Patent [19]

van Tilborg et al.

[11] 4,377,451

[45] Mar. 22, 1983

[54] ELECTROCHEMICAL CONVERSION OF CONJUGATED DIENES INTO ALKADIENEDIOIC ACIDS

[75] Inventors: Wilhelmus J. M. van Tilborg; Cornelis J. Smit, both of Amsterdam, Netherlands

[73] Assignee: Shell Oil Company, Houston, Tex.

[21] Appl. No.: 233,264

[22] Filed: Feb. 10, 1981

[30] Foreign Application Priority Data

Feb. 19, 1980 [GB] United Kingdom ..... 8005543

[51] Int. Cl.[3] ..... C25B 3/00; C25B 3/10

[52] U.S. Cl. ..... 204/59 R; 204/72

[58] Field of Search ..... 204/59 R, 72, 73 R

[56] References Cited

U.S. PATENT DOCUMENTS

| | | | |
|---|---|---|---|
| 3,032,489 | 5/1962 | Loveland | 204/73 |
| 3,344,045 | 9/1967 | Neikam | 204/59 R |
| 4,028,201 | 6/1977 | Tyssee | 204/72 |

OTHER PUBLICATIONS

R. V. Lindsey and M. L. Peterson, "Synthesis by Free-radical Reactions. X", *J. Am. Chem. Soc., 81, (1959), pp. 2073–2074.*

Fioshin et al, Chem. Abstracts, 63, (1965), abstract No. 15858C.

*Primary Examiner*—F. Edmundson

[57] ABSTRACT

A process for the preparation of alkadienedioic acids by the electrochemical conversion of carbon dioxide and conjugated diene reactants in an electrolysis medium consisting essentially of the reactants, and electrolyte, and an anhydrous aprotic solvent.

10 Claims, No Drawings

ELECTROCHEMICAL CONVERSION OF CONJUGATED DIENES INTO ALKADIENEDIOIC ACIDS

BACKGROUND OF THE INVENTION

This invention relates to an improvement in the process for the electrochemical conversion of conjugated diene compounds into alkadienedioic acids.

Most particularly, this invention relates to the nature of the solvent utilized in the electrolysis reaction of conjugated dienes and carbon dioxide, and to processing improvements for which a certain class of solvents are found to be responsible. It is reported in the art (Fioshin et al, *Chem. Abstr.* 71 (1969)) that conjugated dienes, e.g., butadiene, can be converted into higher polyunsaturated dicarboxylic acids by the electrolysis of butadiene and oxalic acid in an alcohol solvent. It is now observed, however, that carrying out an electrolysis reaction in such a manner results in the formation of a polymeric layer at the anode surface, producing a strong anode polarization and substantially blocking the transfer of current to the electrolysis medium.

It is further disclosed in the art (R. V. Lindsey et al, *J. Am. Chem. Soc.* 81 (1959), 2073–2074) that butadiene can be converted into diethyl-3,7-decadiene-1,10-dioate by electrolysis in a methanol or methanol/water solvent and in the presence of a mixture of a half ester of a lower dicarboxylic acid and a half ester salt of the same dicarboxylic acid serving as a source of carbethoxy radicals. Apparently, a large variety of products are prepared by this method. Lindsey et al also report that electrolysis of methanol solutions of ethyl hydrogen maleate and either butadiene or isoprene formed films on the anode which greatly reduced the conductance of the electrolytic cell and the efficiency of the desired reactions.

The electrochemical conversion of conjugated dienes into alkenoic acids and alkenedioic acids, for instance, the conversion of butadiene into pentenoic and hexenedioic acids, is disclosed in U.S. Pat. Nos. 3,032,489 and 3,344,045. These patents, however, fail to describe the preparation of alkadienedioic acids. With specific regard to the use of anhydrous aprotic solvents according to the invention, the teachings of U.S. Pat. No. 3,032,489 disclose that a number of aprotic substances are suitable as solvents in the electrolysis mixture. However, the patent further teaches that the electrolysis solvent medium preferably also contains an amount of water, i.e., between 0.5 and 25 percent by weight based on solvent, which serves as a source of hydrogen ions. Water is said to be unnecessary if the solvent functions as a source of such ions, in which case the solvent would not, by definition, be described as aprotic.

SUMMARY OF THE INVENTION

It has now been found that conjugated dienes can be converted electrochemically into alkadienedioic acids with good current yields and with improved selectivity, in a process which is substantially free of the aforementioned problems which have characterized related processes of the art. The invention centers upon the employment of an anhydrous, aprotic electrolysis solvent.

In summary, the invention may be described as an improvement in the process for the preparation of alkadienedioic acids by the conversion of carbon dioxide and conjugated diene reactants, said diene consisting essentially of compounds of formula I

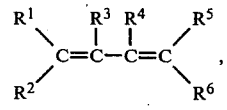

(I)

wherein $R^1$, $R^2$, $R^3$, $R^4$, $R^5$ and $R^6$ are each individually selected from the class consisting of hydrogen and optionally substituted alkyl, aryl, alkaryl and aralkyl groups having up to 12 carbon atoms, in the presence of an added electrolysis solvent and an electrolyte, said improvement comprising the utilization as the electrolysis solvent of an essentially anhydrous aprotic solvent.

DESCRIPTION OF THE PREFERRED EMBODIMENTS

With the exception of the employment of a particularly-defined electrolysis solvent, the process of the invention is suitably practiced according to electrochemical processing methods disclosed or suggested by the relevant arts.

Thus, for instance, the class of conjugated dienes which is suitably applied as starting material for conversion to alkadienedioic acid in the process of the invention is of generally conventional definition. For purposes of the invention the conjugated dienes are described in terms of formula I, above. Preference is given to the use of conjugated dienes according to formula I, wherein $R^1$, $R^2$, $R^3$, $R^4$, $R^5$, and $R^6$, each individually represent a hydrogen atom or an alkyl group having up to 6 carbon atoms, or an aryl, alkaryl or aralkyl group having up to 9 carbon atoms. More preferred are such conjugated dienes wherein each of the $R^1$, $R^2$, $R^3$, $R^4$, $R^5$, and $R^6$ substituents individually represents a hydrogen atom, a methyl group, an ethyl group, or a phenyl group. Most preferred as starting materials are the compounds butadiene, isoprene, 1,3-pentadiene and 2,4-hexadiene. Particularly preferred is the application of the invention to the electrochemical conversion of 1,3-butadiene to the decadienedioic acids.

Electrolysis of the dienes for conversion to alkadienedioic acids is suitably accomplished in conventional electrolysis cells, for instance, of either the one-compartment or two-compartment type. A two-compartment electrolysis cell is one which comprises a cell divider to separate the electrodes in order to prevent the decomposition at one electrode of product formed at the other electrode. Suitable cell dividers comprise ion-exchange membranes as well as porous diaphrams such as glass-frit, alundum, asbestos or porous polymer foils. Particularly good results have been obtained using a cation-exchange membrane (such as a Nafion-type membrane) or a glass frit. In the two-compartment electrolysis cell, it is necessary for purposes of the invention to use the specified anhydrous aprotic solvent as solvent in the catholytic compartment of the cell. For the anolytic compartment, conventional solvents for the service may be suitably employed.

Necessarily present in the solvent medium of the cell is an electrolyte. Electrolytes which can be used in the two-compartment electrolysis cell are well known in the art. For instance, alkali and alkaline earth metal salts, tetraalkyl ammonium salts, heterocyclic and (alk)aryl ammonium salts, the corresponding anions comprising inorganic as well as organic anions, e.g., phosphates, halides, perchlorates, sulfates, aryl sulfonates or alkyl sulfates, can be used. Particularly good results have been obtained using tetraethyl ammonium chloride or tetraethyl ammonium perchlorate.

It has also now been found that a further class of ammonium salts can be used as electrolytes in electrolysis processes according to the present invention using a two-compartment cell. This class comprises salts according to the general formula AB, wherein A represents an alkali or alkaline earth metal moiety; a group of formula $N^{\oplus}R^7R^8R^9R^{10}$, wherein $R^7$, $R^8$, $R^9$ and $R^{10}$, each individually represents a hydrogen atom, an alkyl group of up to 8 carbon atoms, or an aryl group, which may be substituted by one or more lower alkyl groups; or a pyridinium ion which may be substituted by one or more lower alkyl groups; and B represents an azide group; a group

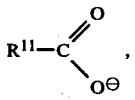

wherein $R^{11}$ represents a hydrogen atom, a group

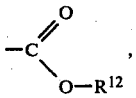

wherein $R^{12}$ represents a hydrogen atom, an alkyl group of up to 8 carbon atoms or a group A; or a group $—CH_2OR^{13}$, wherein $R^{13}$ represents a hydrogen atom, an alkyl group of up to 8 carbon atoms, or an aryl group which may be substituted by one or more lower alkyl groups. Examples of compounds according to the general formula AB are ditetraethylammonium oxalate (DTEAOx) and tetraethylammonium formate (TEAForm). Sometimes the presence of a second electrolyte, such as a lithium salt, e.g. lithium perchlorate, has an advantageous effect on the current density of the electrochemical conversion without affecting the selectivity towards alkadienedioic acids.

The use of compounds to the general formula AB is also advantageous in that they decompose at the counter-electrode under the prevailing reaction conditions to give either nitrogen or carbon dioxide which in the latter case may be transported to the other compartment as an (additional) source of carbon dioxide reactant.

The process of the present invention can also be carried out in a one-compartment cell. As is generally known in the art, practice of electrolysis in a one-compartment cell is very advantageous, provided the materials converted at the counter-electrode and their products do not substantially interfere with the reaction at the working electrode. It is also advantageous when the products formed at the working electrode are easily separable from those formed at the counter-electrode and when cheap, easily available materials can be used as starting materials for the reaction at the counter-electrode.

It is found that alkadienedioic acids can be produced in a one-compartment cell in an anhydrous aprotic solvent, when use is made, as cell electrolytes, of compounds having the general formula AB, wherein A and B are as defined hereinbefore. Preference is given to the use of compounds according to the general formula AB, wherein A represents an alkali or alkaline earth metal moiety; a group of formula $N^{\oplus}R^7R^8R^9R^{10}$, wherein each of $R^7$, $R^8$, $R^9$ and $R^{10}$, which may be the same or different, represents an alkyl group of up to 4 carbon atoms; a phenyl group; or a pyridinium ion; and B represents a group

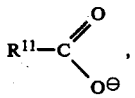

wherein $R^{11}$ represents a hydrogen atom; a group

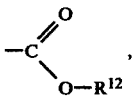

wherein $R^{12}$ represents a hydrogen atom, an alkyl group of up to 8 carbon atoms or a group A; or a group $—CH_2OR^{13}$, wherein $R^{13}$ represents a hydrogen atom or an alkyl group of up to 8 carbon atoms.

More preferably, use is made of compounds according to the general formula AB, wherein A represents a group of the formula $N^{\oplus}R^7R^8R^9R^{10}$, wherein $R^7$, $R^8$, $R^9$ and $R^{10}$, each individually represents a methyl or ethyl group; and B represents a group

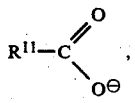

wherein $R^{11}$ represeents a hydrogen atom; or a group

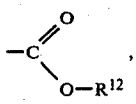

wherein $R^{12}$ represents a hydrogen atom, an alkyl group of up to 4 carbon atoms or a group A. Examples of such compounds comprise ditetraethylammonium oxalate (DTEAOx), tetraethylammonium hydrogen oxalate (TEAHOx) and tetraethylammonium formate (TEAForm). Mixtures of electrolytes, e.g., mixtures of two compounds, both according to the general formula AB, are suitably employed.

A type of one-compartment which is especially suited for the electrochemical conversion according to the present invention is the capillary gap cell. This cell can be used in batch-wise as well as in semi-continuous or continuous operations. Also, known modifications of the capillary gap cell, such as the pump cell or the trickle-tower cell, can be used in carrying out the process according to the invention.

For practice of the invention, the electrolysis cell is equipped with electrodes that are relatively inert under reaction conditions. Anodes comprising platinum or carbon are particularly suitable, although other materials such as lead dioxide can be used as well. Examples of suitable cathodic materials are cadmium, lead, mercury, and mercurated lead. The combination of a platinum or carbon anode and a mercury or mercurated lead cathode is particularly preferred.

In the operation of the invention, various current densities may be suitably provided in the electrolysis cell. Generally, it will be advantageous to employ relatively high current densities in order to achieve a high degree of use of the cell's capacity, although other factors, e.g., source of the current, resistance of the reaction medium, heat dissipation, and desired current yields of products, must be taken into account. Current densities of from about 5 to 1000 mA/cm$^2$ are suitably applied in the practice of the invention. Preference is given to current densities of at least 15 mA/cm$^2$.

In the practice of the invention, there is provided to the cell a liquid mixture of the diene, the electrolyte, and the substantially anhydrous aprotic solvent. By characterizing the solvent as anhydrous, it is intended that the solvent be substantially anhydrous, i.e., that it contain less than 1.0 percent by weight water, preferably less than 0.5 percent by weight water, more preferably less than about 0.3 percent by weight water, and most preferably less than about 0.2 percent by weight water. The solvent is characterized as aprotic according to the conventional definition of the term; an aprotic solvent for purposes of the invention is thus defined as one which neither gains nor loses a proton to the reacting solute during the course of the electrolysis. Suitable solvents for purposes of the invention are exemplified by ethers such as dimethoxyethane, diethyl ether, tetrahydrofuran, and macrocyclic polyethers (e.g., 1,4,7,10,13,16-hexaoxacyclooctadecane and other crown ethers); by chlorinated and fluorinated hydrocarbons; by nitriles such as acetonitrile; by formamides such as dimethylformamide; by sulfolane and substituted sufolanes, by organic carbonates such as propylene carbonate; and by other solvents such as nitromethane, N-methyl-2-pyrrolidone, and hexamethylphosphoric triamide. Anhydrous acetronitrile is particularly preferred, although the choice of the optimum solvent for a given diene conversion will depend upon the potential to be applied during the electrolysis. In this regard, as is known in the art, consideration is given to what has been termed the decomposition potential as a criteria for solvent selection or for choice of electrolysis potential, for instance, according to the teachings of U.S. Pat. Nos. 3,032,489 and 3,344,045. It has further been noted that the aprotic solvent is preferably one with a relatively high dielectric constant, in which case it functions to provide a relatively low electrical resistance within the cell.

In addition to the diene, there is necessarily supplied to the electrolysis cell carbon dioxide reactant. As is recognized in the art, the carbon dioxide may be generated in situ during the reaction, but is more commonly added to the cell as a vapor, e.g., bubbled through the solvent/electrolyte/diene mixture.

During electrolysis under the invention, diene reactant is typically present in the anhydrous aprotic solvent in a concentration of up to about 40 percent by volume. From the standpoint of yield of desired alkadienedioic acids from a given supply of current (i.e., termed current yield) and selectivity for the alkadienedioic acids, it is generally desirable, however, to operate with an electrolysis solution containing conjugated diene in an amount less than about 10 percent by volume, more preferably less than about 5 perent by volume. Very good results are obtained using such low concentrations of diene, particularly butadiene, in combination with moderate carbon dioxide pressures in the cell, e.g., on the order of 10 bar or less.

The process according to the present invention can be carried out in a wide range of temperatures. Temperatures in the range of from +120° to −30° C. can be suitably applied, with preference being given to temperatures in the range of from +80° to 20° C. It is on occasion found that temperatures below 0° C. are to be preferred for reason of process selectivity in alkadienedioic acid production. Normally, however, very good results are obtained when the electrochemical conversion is carried out at, or slightly below, ambient temperature.

The electrochemical conversions can be suitably performed under a supply of carbon dioxide to the cell at atmospheric or higher pressure. Pressures up to 50 bar can be suitably applied, although preference is given to pressures less than about 20 bar. It is also possible to carry out the electrochemical conversions without the supply of carbon dioxide from an external source, but instead in the presence of substances, for instance, oxalates and/or formates, which undergo reaction to yield carbon dioxide in situ.

The alkadienedioic acids which are produced according to the process of the invention principally comprise beta-gamma and/or gamma-delta alkadienedioic acids; i.e., dicarboxylic acids having the two carbon-carbon double bonds in positions which are beta-gamma or gamma-delta with respect to the nearest carboxylic group. For instance, when butadiene is subjected to the electrochemical process according to the present invention, a mixture of alkadienedioic acids is obtained comprising 3,7-decadinedioic acid, as well as 6-vinyloctene-3 dioic acid and 3,4-divinylhexanedioic acid. Alkenoic acids and alkenedioic acids are normally formed as by-products in relatively small amounts. The use of an anhydrous aprotic solvent is of substantial importance to the preparation of the desired alkadienedioic acids, rather than such by-products.

Following electrolysis, alkadienedioic acids may be recovered from the product mixture by a variety of procedures. For instance, the acids may be converted into corresponding alkyl esters by treatment with an alkyl halide such as methyl iodide. These esters are then easier to separate from the starting materials and by products, for example, by chromatrography, distillation, solvent extraction, or a combination of recovery techniques. It is also possible to isolate free acids from product salts by means of acid-base extraction. For purposes of product analysis, composition of the acids may be determined by gas-liquid chromatography, after treatment with an appropriate silylating or alkylating agent.

Alkadiene acids prepared by practice of the present invention are materials known to the art, having utility, for instance, in the manufacture of air-curable resins and in the synthesis of polyols and other organic compounds. The alkadienedioic acids may also be converted to the corresponding esters, which are useful as plasticizers and as starting materials for the production of polyethers. Decadienedioic acid finds particular utility in the preparation of sebacic acid.

The invention will now be further described by the following examples, which are intended to illustrate specific embodiments of the invention and not to limit its broader scope.

The experiments described in examples 1–9 were carried out in an H-type two-compartment electrolysis cell provided with a cation-exchange membrane (Nafion). This cell contained a platinum anode and a cathode (10 cm$^2$)/Luggin-capillary-SCE reference cell assembly. The anolyte was a one percent solution of sulfuric acid in water.

The experiments described in examples 10–20 and 22–25 were carried out in a 50 ml glass autoclave provided with two electrodes, each having a surface-area of 6 $cm^2$. A reference electrode was situated within the vessel. The potential of the working electrode was controlled by means of a reference electrode contacted with the solution by a Luggin-capillary. The experiments were carried out in the presence of atmospheric or greater carbon dioxide pressure.

The experiment described in example 21 was carried out in a capillary gap cell. (A capillary gap cell comprises a series of cylindrical, bipolar graphite discs with a central orifice through which the electrolyte and the appropriate substrates were introduced. They flow radially to the periphery of the discs where they are collected and withdrawn). The carbon dioxide pressure applied was 4 bar. The flow rate of the electrolyte was maintained at 3 l/min.

Normally available electrodes were used in the experiments with the exception of mercurated lead electrodes which were prepared by either reducing an aqueous solution of Hg(II) acetate at −0.90 V vs Saturated Calomel Electrode (SCE)/180 mA for 15 minutes on a lead electrode or by rubbing polarographically pure mercury on a freshly cleaned lead surface.

The products obtained were identified by one or more of the following techniques: gas/liquid chromatography, mass spectrometry, proton nuclear magnetic resonance, $^{13}C$ nuclear magnetic resonance and infrared spectroscopy.

EXAMPLE 1

An electrochemical conversion of butadiene into decadienedioic acids was performed in the two-compartment cell described above. A lead cathode was used. The catholyte was 100 ml of dry acetonitrile solvent containing 1.1 mol per liter of tetraethylammonium perchlorate (TEAP) as electrolyte. An equimolar mixture of carbon dioxide and butadiene was introduced continuously in the cathode compartment at room temperature. A reduction potential of −2.20 V versus SCE was applied; during the experiment the total current passed was 14976 C. A product mixture was obtained which contained 234 mg of acidic product (together with 18 mg of neutral product) analysed after silylation of the reaction mixture with bis-trimethylsilyl acetamide to facilitate product analysis. Analysis by gas/liquid chromatography indicated that 63 mg of a mixture of the following decadienedioic acids had been obtained: predominantly 3,7-decadienedioic acid, 6-vinyloctene-3-dioic acid and 3,4-divinylhexanedioic acid. The remainder of the acidic product was 3-pentenoic acid. The selectivity to decadienedioic acids (expressed as mg decadienedioic acid produced per mg of both 3-pentenoic acid and decadienedioic acids) was 27%.

EXAMPLE 2

Electrochemical conversion of butadiene was again performed, generally according to the procedures of example 1, but employing a catholyte containing only 0.1 mol per liter of TEAP. The total current passed through the cell in this example was 1836 C. The product obtained totalled 364 mg, of which 350 mg was acidic and 14 mg was neutral compounds. Decadienedioic acids were formed in a total amount of about 70 mg and a selectivity of about 20 percent.

EXAMPLE 3

The experiment of example 2 was repeated, utilizing, however, a mercury cathode, 1.1 mol of TEAP per liter of catholyte, and a reduction potential of −2.30 V versus SCE. Total current passed to the cell during this example was 4274 C. A total of 240 mg of acidic product was obtained, together with 55 mg of neutral product. Decadienedioic acids were formed in a quantity of 89 mg and a selectivity of 37 percent.

COMPARATIVE EXAMPLE A

The electrochemical conversion of butadiene was performed in a manner not according to the invention. Generally, the procedures of example 3 were followed; however, the dry acetonitrile catholyte solvent was replaced by a two part water to one part acetonitrile mixture. A reduction potential of −2.25 V versus SCE was applied, and a total current of 4308 C was passed to the cell. Only about 17 mg of neutral product was obtained; acidic products were not detected in the product mixture.

EXAMPLE 4

The procedures of example 3 were repeated, employing 2.0 mols of tetraethylammonium chloride (TEACl) electrolyte per liter of the catholyte solution. A reduction potential of −2.37 V versus SCE was applied and a total current of 1556 C was passed to the cell. Acidic product was obtained in a quantity of 300 mg, together with 6 mg of neutral product. Decadienedioic acids were formed in a quantity of 99 mg, with a selectivity of 33 percent.

EXAMPLE 5

Procedures of example 4 were again followed, employing, however, 0.15 mol of TEACl per liter of catholyte. Under a reduction potential of −2.70 V versus SCE and a total current of 2000 C, there was formed 421 mg of acidic product and 20 mg of neutral product. Decadienedioic acids were obtained in a quantity of 181 mg and a selectivity of 43 percent.

COMPARATIVE EXAMPLE B

The experiment described in example 5 was repeated, but in a manner not in accordance with the invention, utilizing acetonitrile containing 1.0 percent water as catholyte solvent. Under a reduction potential of −2.70 V versus SCE, a current density of 7.5 $mA/cm^2$, and a total current of 1578 C, there was produced only 82 mg of acidic product. Decadienedioic acids were formed in very low current yield and with moderate selectivity. The acidic product contained a substantial amount of formic acid.

EXAMPLE 6

The procedures of example 5 were repeated, using as solvent, however, acetonitrile containing 0.1 percent water. Reduction potential was −2.70 V versus SCE; current density was 12.5 $mA/cm^2$; total current was 2107 C. This experiment yielded 171 mg of acidic product, and decadienedioic acids in a selectivity of 46 percent.

EXAMPLE 7

Under the general procedures of example 6, butadiene was subjected to electrolysis utilizing, as catholyte solvent, acetonitrile containing 0.5 percent water.

Under a reduction potential of −2.70 V versus SCE, a current density of 7.5 mA/cm$^2$, and a total current of 1270 C, 140 mg of acid product was obtained. Decadienedioic acids were formed with a selectivity of 40 percent; formic acid was also observed in the product.

EXAMPLE 8

The procedures of example 3 were repeated, utilizing, however 0.1 mol of tetrabutyl ammonium perchlorate (TBAP) electrolyte per liter of catholyte solution. Reduction potential was −2.80 V versus SCE; total current was 1100 C; current density was 6 ma/cm$^2$. Acidic (140 mg) and neutral (13 mg) products were obtained. Decadienedioic acids (38 mg) were formed with a selectivity of 27 percent.

EXAMPLE 9

Butadiene was subjected to electrolysis under the general procedures of example 7, but using as electrolyte 0.1 mol of lithium perchlorate per liter of the catholyte solution. Reduction potential was −2.80 V versus SCE; total current was 1100 C; current density was 18 mA/cm$^2$. There was produced 268 mg of acidic product and 8 mg of neutral product. Decadienedioic acids were formed in a quantity of 75 mg and a selectivity of 28 percent.

EXAMPLE 10

The electrochemical conversion of butadiene into decadienedioic acids was carried out in a one-compartment cell (glass autoclave) using a mercurated lead cathode and a platinum anode. Dry acetonitrile was used as solvent. Ditetraethylammonium oxalate (DTEAOx), in a concentration of 0.14 mol per liter, was employed as the conducting (electrolyte) salt and as a substrate for oxidation at the anode. An equimolar mixture of carbon dioxide and butadiene was continuously bubbled through the solution at ambient temperature. Applied cathodic potential was −2.10 V versus SCE; total current passed to the cell was 1024 C; current density was 8 mA/cm$^2$. There was obtained 400 mg of acidic product and 7 mg of neutral product. Decadienedioic acids (predominantly 3,7-decadienedioic acid) were formed in a quantity of 152 mg, a selectivity of 38 percent, and a current yield of 15 percent.

EXAMPLE 11

The methods of example 10 were again applied, but utilizing 0.23 mol per liter of DTEAOx as electrolyte. Under an applied cathodic potential of −2.30 V versus SCE, a total current of 1877 C, and a current density of 20 mA/cm$^2$, there was produced 700 mg of acidic product and 10 mg of neutral product. Decadienedioic acids (294 mg) were formed with a selectivity of 42 percent and a current yield of 15 percent.

EXAMPLE 12

An experiment according to example 10 was again conducted, but with 0.17 mol per liter of tetraethylammonium hydrogen oxalate as electrolyte. Applied cathodic potential was −2.20 V versus SCE; total current of 960 C was passed to the cell. There was produced 161 mg of acidic product and 71 mg of neutral product. Decadienedioic acids (35 mg) were obtained in a selectivity of 22 percent and a current yield of 4 percent.

EXAMPLE 13

The electrochemical conversion of butadiene into decadienedioic acids was carried out in the general manner of example 10; utilizing, however, 0.23 mol of DTEAOx electrolyte per liter of the dry acetronitrile solution. Example 13 was performed at 23° C. under a carbon dioxide pressure of ten bar, in a cell (autoclave) containing 9 percent by volume butadiene. Reduction potential applied was −2.50 V (versus a Ag/$AgNO_3$ solution, 0.1 mol per liter, in acetonitrile); total current was 500 C; initial current density was 85 mA/cm$^2$. Acidic product in a quantity of 80 mg was obtained, together with 21 mg of neutral product. Decadienedioic acids (26 mg) were formed with a selectivity of 33 percent and a current yield of 5 percent. A slight degree of anode polarization was observed.

EXAMPLE 14

The general procedures of example 13 were repeated utilizing, however, a cell temperature of −15° C., a carbon dioxide pressure of 8 bar, an applied reduction potential of −2.40 V (versus a Ag/$AgNO_3$ solution, 0.1 mol per liter in acetonitrile), a total current of 710 C, and an initial current density of 50 mA/cm$^2$. There was obtained 24 mg of acidic product and 13 mg of neutral product. Decadienedioic acids were formed with a selectivity of 92 percent, at a current yield of 3 percent. A slight degree of anode polarization was observed.

EXAMPLE 15

The general procedures of example 10 were again followed, but employing a mercury cathode, tetraethylammonium formate (TEAForm) as electrolyte in a concentration of 0.46 mol per liter in the dry acetonitrile solvent, an applied cathodic potential of −2.20 V versus SCE, a total current of 2000 C, and a current density of 19 mA/cm$^2$. Acidic product (1156 mg) and neutral product (56 mg) were obtained. Of the acidic product, 40 percent was decadienedioic acids, obtained at a current yield of 22 percent and a selectivity of 43 percent, calculated as the weight of decadienedioic acids divided by the total weight of decadienedioic acids, 3-pentenoic acid, and 3-butenedioic acid in the product mixture.

EXAMPLE 16

An experiment was performed according to the general methods of Example 15, using a mercurated lead cathode. Under an applied cathodic potential of −2.30 V versus SCE, a total current of 1820 C, and a current density of 15 mA/cm$^2$, 680 mg of acidic product was obtained together with 38 mg of neutral product. The acidic product contained 45 percent by weight decadienedioic acids (a current yield of 16 percent) for a selectivity, as defined in example 15, of 54 percent.

EXAMPLE 17

Under the general procedures of example 16, but employing the TEAForm electrolyte in a concentration of 0.115 mol per liter of the acetonitrile, an applied cathodic potential of −2.30 V versus SCE, a total current of 873 C, and a current density of 12 mA/cm$^2$, there were obtained 264 mg of acidic product and an undetermined quantity of neutral product. Fifty-two percent by weight of the acidic compound consisted of decadienedioic acids (current yield 8 percent) at a selectivity of 58 percent.

EXAMPLE 18

The general procedures of example 16 were again repeated, but using as solvent an acetonitrile solution containing 0.5 percent water. Under an applied cathodic potential of −2.30 V versus SCE, a total current of 2667 C, and a current density of 27 mA/cm$^2$, the electrolysis yielded 1110 mg of acidic product and 51 mg of neutral product. The acidic product contained 30 percent by weight (333 mg) of decadienedioic acids, with a selectivity of 35 percent.

COMPARATIVE EXAMPLE C

The experiment described in example 18 was repeated, but using as solvent an acetonitrile solution containing 2 percent water, and thus not in accordance with the invention. Applied cathodic potential was −2.30 V versus SCE; total current was 2000 C; current density was 25 mA/cm$^2$. Only 328 mg of acidic product were obtained, together with 50 mg of neutral product. Decadienedioic acids were formed (141 mg) in low current yield.

EXAMPLE 19

Electrochemical conversion of butadiene into decadienedioic acids was again carried out under general procedures described in example 10. Dry acetonitrile was used as the solvent; the electrolyte was TEAForm in a concentration of 0.46 mol per liter. This example was performed under a carbon dioxide pressure of 6 bar, while the autoclave contained butadiene at a concentration of 4.8 percent by volume. Applied cathodic potential was −2.58 V (versus a Ag/$AgNO_3$ solution, 01 mol per liter, in acetonitrile); total current was 500 C; current density was 18 mA/cm$^2$. There were obtained acidic product, in a quantity of 134 mg, and neutral product in a quantity of 15 mg. About 85 percent by weight of the acidic product was decadienedioic acids. Composition of the decadienedioic acids, determined by converting the acids to corresponding trimethylsilyl esters, and analyzing the esters by gas/liquid chromatography, was 64 percent 3,7-decadienedioic acid, 31 percent 6-vinyl-octene-3-dioic acid, and 5 percent 3,4-divinyl-hexanedioic acid.

EXAMPLE 20

The general procedures of example 19 were followed, utilizing, however, dimethylformamide solvent, applied cathodic potential of −2.65 V (versus a Ag/$AgNO_3$ solution, 0.1 mol per liter in acetonitrile), a total current of 562 C, and a current density of 10 mA/cm$^2$. There were formed 48 mg of acidic product (80 percent by weight decadienedioic acids and 20 percent by weight hexenedioic acid), together with 35 mg of neutral product.

EXAMPLE 21

For this example, butadiene was electrochemically converted into decadienedioic acids in the capillary gap cell described above. The conversion was performed in the presence of carbon dioxide while the cell contained 4 percent by volume of butadiene. A lead cathode and a platinum anode were employed. Solvent was dry acetonitrile; electrolyte was TEAForm in a concentration of 0.46 mol per liter. During the electrolysis, current density was 40 mA/cm$^2$, cell solution temperature was 12° C., flowrate of the electrolyte-containing solution was 180 liters per hour. After 15 minutes, and the passage of a total current of 1800 C to the cell, the electrolysis yielded 3160 mg of carboxylic acids together with 96 mg of neutral product.

Decadienedioic acids were produced in a quantity of 85 percent by weight, based on total carboxylic acids; current yield of decadienedioic acids was 56 percent. Hexenedioic acid (12 percent by weight and 14 percent current yield) and glycolic acid (3 percent by weight and 9 percent current yield) were also formed.

The reaction was continued for an additional 30 minutes, consuming a total of 5400 C current. Total carboxylic acids formed were 3240 mg,together with 100 mg of neutral products. Decadienedioic acids (predominantly 3,7-decadienedioic acids) were formed in an amount of 67 percent by weight, based on total carboxylic acids, and with a current yield of 39 percent. Hexenedioic acid (27 percent by weight and 21 percent current yield) and glycolic acid (6 percent by weight and 17 percent current yield) were also formed.

EXAMPLE 22

The general procedures of example 10 were followed for the electrolysis reaction, in this case utilizing, however, isoprene as the diene reactant at a concentration of 10 percent by volume in the electrolysis solution. Carbon dioxide was bubbled through the solution at atmospheric pressure. Under an applied cathodic potential of −2.37 V versus SCE and a current density of 18 mA/cm$^2$, carboxylic acids were produced in an overall current yield of 40 percent. Dodecadienedioic acids were produced with a current yield of ten percent, together with $C_6$-alkenoic acids (20 percent current yield) and $C_7$-alkenedioic acids (current yield 10 percent).

EXAMPLE 23

The experiment generally described in example 22 was repeated, this time employing t,t-2,4-hexadiene as the diene reactant, in a concentration of 12 percent by volume. Applied cathodic potential was −2.25 V versus SCE; current density was 16 mA/cm$^2$. Carboxylic acids were produced with a current yield of 10 percent. $C_{14}$-alkadienedioic acids were produced with a current yield of 1.6 percent, $C_7$-alkenoic acids with a current yield of 5 percent, and $C_8$-alkenedioic acids with a current yield of 3.4 percent.

EXAMPLE 24

Under the general procedure of example 22, but utilizing a lead cathode, a c,t-1,3-pentadiene reactant (9 percent by volume), an applied cathodic potential of −2.32 V versus SCE, and a current density of 15 mA/cm$^2$, there were produced carboxylic acids in a current yield of 86 percent. $C_{12}$-alkadienedioic acids were produced with a current yield of 14 percent, together with $C_6$-alkenoic acids (current yield 26 percent) and $C_7$-alkenedioic acids (current yield 46 percent).

EXAMPLE 25

Repeating the experiment of example 24, but using TEAForm as electrolyte (0.46 mol per liter), an applied cathodic potential of −2.28 V versus SCE, and a current density of 19 mA/cm$^2$, there were produced carboxylic acids in a current yield of 59 percent. $C_{12}$-alkadienedioic acids were prepared in a current yield of 20 percent, together with $C_6$-alkenoic acids (13 percent current yield) and $C_7$-alkenedioic acids (26 percent current yield).

We claim as our invention:

1. A process for the preparation of alkadienedioic acids which comprises steps for (a) subjecting a carbon dioxide reactant and a conjugated diene reactant to electrolysis in the presence of an essentially anhydrous aprotic electrolysis solvent and an electrolyte, said diene reactant consisting essentially of compounds of the formula:

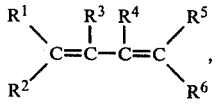

wherein $R^1$, $R^2$, $R^3$, $R^4$, $R^5$, and $R^6$ each individually represents a hydrogen atom or an optionally substituted alkyl, aryl, alkaryl or aralkyl group having up to 12 carbon atoms, to produce an electrolysis product mixture, and (b) recovering alkadienedioic acids from the product mixture.

2. The process of claim 1, wherein the conjugated diene reactant is characterized as having $R^1$, $R^2$, $R^3$, $R^4$, $R^5$ and $R^6$ substituents which each individually represent a hydrogen atom, an alkyl group having up to 6 carbon atoms, or an aryl, alkaryl, or aralkyl group having up to 9 carbon atoms.

3. The process of claim 2, wherein the conjugated diene reactant consists essentially of a diene selected from the class consisting of butadiene, isoprene, 1,3-pentadiene, 2,4-hexadiene, and mixtures thereof.

4. The process of claim 1, wherein the aprotic solvent is selected from the class consisting of ethers, chlorinated or fluorinated, hydrocarbons, nitriles, formamides, sulfolanes, organic carbonates, nitromethane, N-methyl-2-pyrrolidone, and hexamethylphosphoric triamide.

5. The process of either claim 2, claim 3, or claim 4, wherein the anhydrous aprotic solvent contains less than 0.5 percent by weight water.

6. The process of claim 5, wherein the electrochemical conversion is performed in a one-compartment cell, using as electrolyte, a compound of the formula AB, wherein A represents an alkali metal or alkaline earth metal; a group of the formula $N^{\oplus}R^7R^8R^9R^{10}$, in which each of the $R^7$, $R^8$, $R^9$, and $R^{10}$ substituents individually represents a hydrogen atom, an alkyl group of up to 8 carbon atoms or an aryl or alkaryl group having up to 12 carbon atoms; or a pyridinium ion, optionally subsituted by one or more alkyl groups, and wherein B represents an azide group; a group of the formula

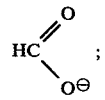

a group of the formula

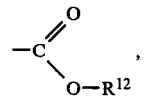

wherein $R^{12}$ is a hydrogen atom, an alkyl group of up to 8 carbon atoms or a group A; or a group of the formula $—CH_2OR^{13}$, wherein $R^{13}$ represents a hydrogen atom or an alkyl group of up to 8 carbon atoms.

7. The process of claim 6, wherein the electrochemical conversion is performed using as electrolyte a salt of the formula AB, wherein A represents an alkali metal or alkaline earth metal; or a group of formula $N^{\oplus}R^7R^8R^9R^{10}$, in which each of $R^7$, $R^8$, $R^9$, and $R^{10}$ is individually selected from the class consisting of an alkyl group of up to 4 carbon atoms, a phenyl group, and a pyridinium ion, and wherein B represents a group of the formula

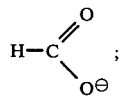

a group of the formula

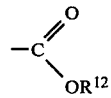

in which $R^{12}$ represents a hydrogen atom, an alkyl group of up to 8 carbon atoms or a group A; or a group of the formula $—CH_2OR^{13}$ in which $R^{13}$ represents a hydrogen atom or an alkyl group of up to 8 carbon atoms.

8. The process of either claim 2, claim 3, or claim 4, wherein the electrolyte is selected from the class consisting of ditetrammonium oxalate and tetraethylammonium formate.

9. The process of either claim 2, claim 3, or claim 4, wherein the anhydrous aprotic solvent is a nitrile or a formamide, and the solvent contains less than about 0.2 percent by weight water.

10. The process of claim 8, wherein the anhydrous aprotic solvent is a nitrile or a formamide, and the solvent contains less than about 0.2 percent by weight water.

* * * * *